US006182617B1

(12) United States Patent
Bigcharles

(10) Patent No.: US 6,182,617 B1
(45) Date of Patent: Feb. 6, 2001

(54) APPARATUS FOR INTERNAL COMBUSTION ENGINE

(76) Inventor: Donald Bigcharles, Box 1441, Blairmore, Alberta (CA), T0K 0E0

( * ) Notice: Under 35 U.S.C. 154(b), the term of this patent shall be extended for 0 days.

(21) Appl. No.: 09/241,740

(22) Filed: Nov. 20, 1998

Related U.S. Application Data

(63) Continuation-in-part of application No. 08/665,306, filed on Jun. 17, 1996.

(51) Int. Cl.[7] ..... F01P 7/14

(52) U.S. Cl. ..... 123/41.1; 123/41.05; 123/41.08; 123/41.09

(58) Field of Search ..... 123/41.05, 41.08, 123/41.01, 41.09, 41.1

(56) References Cited

U.S. PATENT DOCUMENTS 3,877,443 * 4/1975 Henning et al. ..... 123/41.08
4,082,068 * 4/1978 Hale ..... 123/41.02
4,332,221 * 6/1982 Imhof et al. ..... 123/41.08
4,370,950 * 2/1983 Furukubo ..... 123/41.08
5,497,734 * 3/1996 Okada ..... 123/41.1

* cited by examiner

*Primary Examiner*—Tony M. Argenbright
*Assistant Examiner*—Hai Huynh

(57) ABSTRACT

Apparatus for improving the operation of a water-cooled internal combustion engine system which may include at least an internal combustion water-cooled engine, a radiator with interconnecting supply and return passageways, a water circulating pump means and means to regulate the temperature of the water; said apparatus enabling selectably controlling the cooling water temperature regulation, said improved operation including at least improved fuel economy, increased power output and/or increased heat output of a vehicle's interior heater.

7 Claims, 3 Drawing Sheets

APPARATUS FOR INTERNAL COMBUSTION ENGINE

This application is a CIP of Ser. No. 08/665,306, filed Jun. 17, 1996.

BACKGROUND OF THE INVENTION

1. Field of the Invention

This invention discloses the application of new apparatus to enable improving the operation of an internal combustion engine system by selectably controlling the temperature of the cooling water in the engine.

Conventional practice in achieving water cooling for internal combustion engines is to arrange an external radiator with supply and return connections and hoses for appropriate connection to the engine, the cooling water medium being circulated through the engine to the external radiator and back by means of a water pump. It is typical in such cooling systems that a thermostatic flow control valve be provided in the water flow path to enable the engine to achieve normal operating temperature quickly, but also to maintain a substantially steady state temperature according to a pre-arranged temperature set point setting, regardless of variable conditions imposed on the engine. Typically, thermostat settings used in internal combustion engine applications are chosen in the range of 160 deg. F. to 195 deg. F. Such thermostats typically have a non-adjustable set-point and the thermostats are only removed and replaced infrequently in response to failure. In such cases they are typically replaced by a thermostat of a similar set-point temperature in accordance with the original manufacturer's specifications.

It has been known for individual automobile and light truck operators to substitute thermostats of different temperature set points for summer versus winter operation, believing that there will be less risk of engine and transmission overheating if, for example a 160 deg. F. thermostat is used in summer, but that the interior heater will be more effective if a higher temperature thermostat, for example 195 deg. F., is substituted for winter use. The inventor also notes that the radiator cooling system performs at least the auxilliary function of cooling the oil of a vehicle's automatic transmission and that it would similarly benefit from the seasonal changing of low and high temperature thermostats. This seasonal changeover is problematic, however, in that it requires considerable manual effort for removal and exchanging the summer and winter thermostats to accommodate the changing of the seasons.

The inventor has observed that light vehicles manufactured in North America may be equipped from the factory with a higher thermostat set-point of, for example, 195 deg. F., whereas light vehicles from Japan may be equipped from the factory with a lower thermostat set-point of, for example, 160 deg. F. This inventor has observed, however, that vehicles provided with the higher temperature set-point may suffer from poor performance in summer, and those provided with the lower thermostat set point may suffer from poor interior heater output under, for example, winter conditions.

The practical difficulty of changing an engine's water temperature set-point in response to or in anticipation of any particular operating condition or environment imposed upon or anticipated for the engine may also be seen as an impediment to vehicle manufacturers in seeking to fully optimize the operating conditions of the internal combustion engine. It is known by performance enthusiasts, for example, that torque and power output of an engine can be maximized by running the engine under "cooler" water temperature conditions. Also, at least some researchers have recognized that engine knocking is affected by the temperature of the engine's cooling water. It is therefore clear that efforts to optimize this engine operating condition have been hampered by the lack of a simple and practical method of providing a selectable set-point for the internal water temperature condition of the internal combustion engine.

For these reasons a primary objective of this invention is to provide apparatus enabling the selection of one or the other of a higher or lower temperature setpoint from, for example, a relatively "high" set point temperature of 195 deg. F. to a relatively "low" 160 deg. F. in a typical automotive internal combustion engine, without substantial manual effort or disassembly of components of the engine system. Another objective is to provide suitable apparatus to enable a simple retrofitting of existing vehicles with enabling apparatus. Other objectives are to construct such apparatus as utilizing ordinary, inexpensive and readily available thermostatic control valve elements and to avoid complex or costly or bulky additional componentry to be added to the engine system.

2. Description of the Related Art

One avenue of providing apparatus capable of varying the water temperature set-point in an internal combustion engine was disclosed in U.S. Pat. No. 5,390,632 by Ikebe et al. in which were arranged multiple temperature and air pressure sensors, engine speed sensor and a knocking detector in a system to provide inputs to a computer; the computer being programmed to make certain decisions in response to the inputs, such decisions resulting in, for example, the variable operation of a water flow control valve, a cooling fan and a variable speed water pump. This system is obviously complex, expensive, subject to maintenance attention and unsuitable for retrofit application to vehicles already in service. Other novel cooling system apparatus described in known prior art is similarly more complex and less practical to apply to new or existing internal combustion engines than the present invention.

BRIEF SUMMARY OF THE INVENTION

The cooling system apparatus of this disclosure achieves at least two different operating set point temperatures for an internal combustion engine by arranging two conventional thermostats of differing set point temperatures series-wise into the cooling water flow path leading from the engine to the radiator and enabling manual or other selection of which of the two thermostats controls flow in the cooling water flow path.

BRIEF DESCRIPTION OF THE SEVERAL VIEWS OF THE DRAWINGS

Various embodiments of enabling apparatus to effect this variable temperature regulation will now be described with reference to the figures.

DETAILED DESCRIPTION OF THE INVENTION

Figure 1:
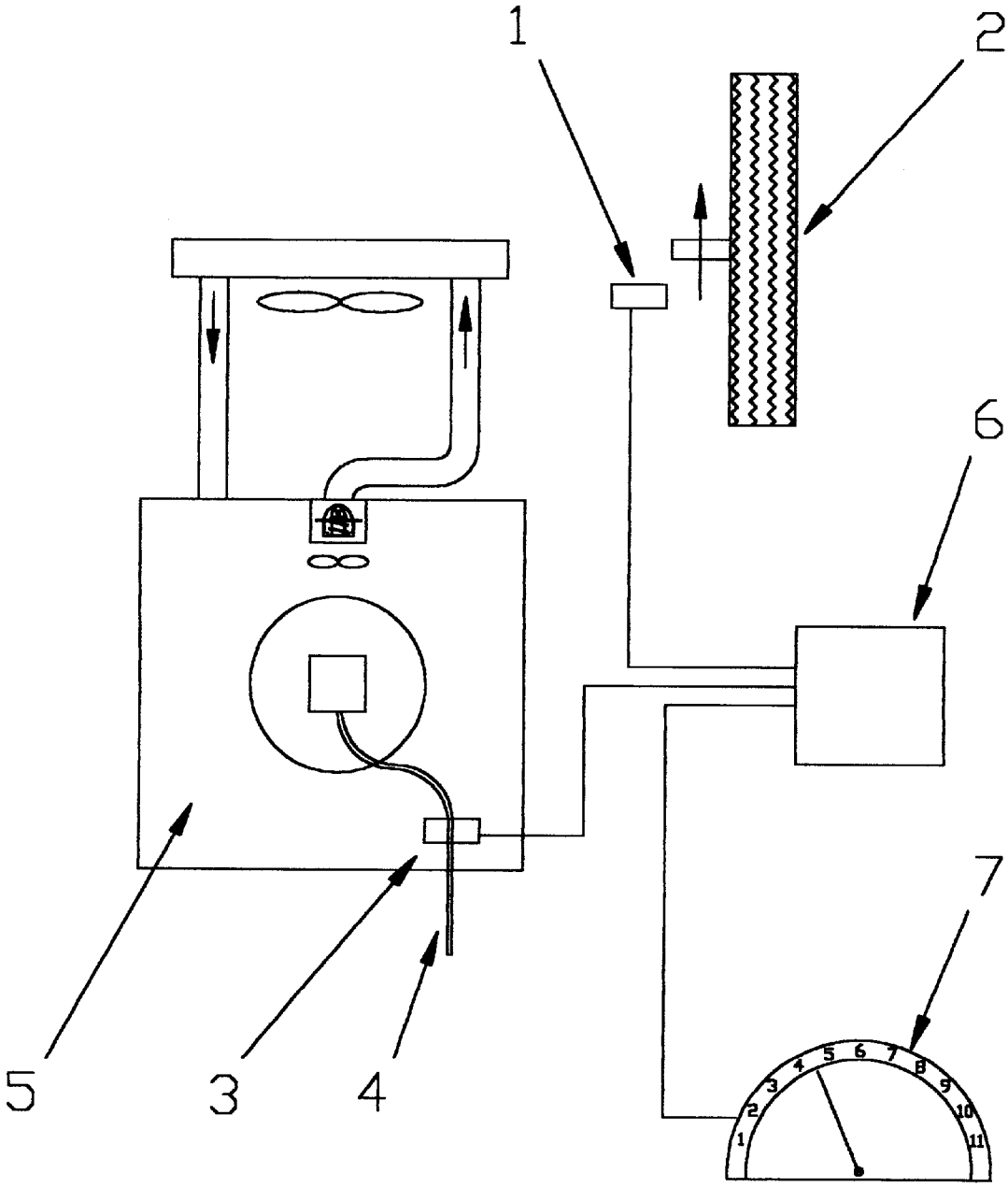
FIG. 1 is a schematic representation of measuring and display means for fuel economy in a vehicle.

FIG. 1 is a schematic representation of measuring and display means for fuel economy in a vehicle, in which a speed sensor 1 detects the rotation of a wheel 2, a sensor 3 detects the rate of fuel delivery in a fuel delivery line 4 to an engine 5. Sensor inputs to a computer 6 are processed with fuel consumption rate per distance results being displayed on a dash-mounted monitor 7. Fuel economy read-outs of this kind are commonly known in automobiles of the 80's and 90's, in which on-board computers and monitors have been programmed to display travel distances, fuel remaining in the tank, fuel economy and other parameters and vehicle diagnostics. With respect to the present invention, the fuel economy read-out provides useful information to the operator about the performance of the vehicle. In particular, the operator could see the effects upon fuel economy by the operation of the vehicle under a first selectable cooling water temperature condition, versus at least a second selectable water temperature condition as under the present invention.

Figure 2:
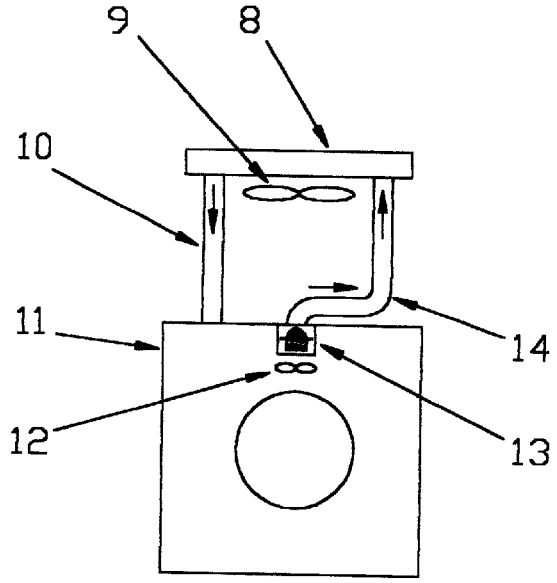
FIG. 2 illustrates a typical cooling system schematic for an internal combustion engine.

FIG. 2 illustrates a typical cooling system schematic diagram for an internal combustion engine, in which water cooling in a radiator 8 is assisted by a fan 9, has a cooled water passageway 10 connecting to an internal combustion engine 11, which has a water pump 12 and a conventional thermostatic flow control valve 13 mounted in or in close proximity to the engine, and a heated water passageway 14 leading back to the radiator 8. The cooled water passageway 10 and the heated water passageway 14 refer to radiator outlet and inlet water flow paths respectively, connecting to engine inlet and outlet connections respectively, and may typically be formed of reinforced rubber hoses of from 1" to 2" internal diameter. Thermostat 13 is only operable at a single set-point temperature typically chosen in the range of 160 deg. F. to 195 deg. F. depending upon the manufacturer's specification. Other components of a typical cooling system such as the pressure-release radiator cap, the interior heater, the transmission oil cooling provisions and the internal water flow passageways of the engine and other miscellaneous features known to comprise internal combustion engines and their cooling systems are omitted from the schematic diagram for simplicity. As well, the driving arrangement of the radiator's cooling fan and the water pump are omitted from the schematic.

In operation, the thermostatic flow control valve 13 initially remains closed while the engine warms up. At its pre-set operating temperature the valve begins to open and will have fully opened over a small additional temperature rise of typically 10 to 20 deg. F. Variable loading of the engine imposes variable heat dissipation duty on the cooling system, which responds by appropriately increasing or decreasing the water flow rate by means of variable opening of the temperature-responsive thermostatic flow control valve 13 within its operating temperature range. The temperature set-point of a typical engine thermostat is not adjustable, however. Also, access to the thermostat for inspection and/or replacement involves at least partial draining of the radiator/engine coolant and nominal engine disassembly and subsequent reassembly.

Figure 3:
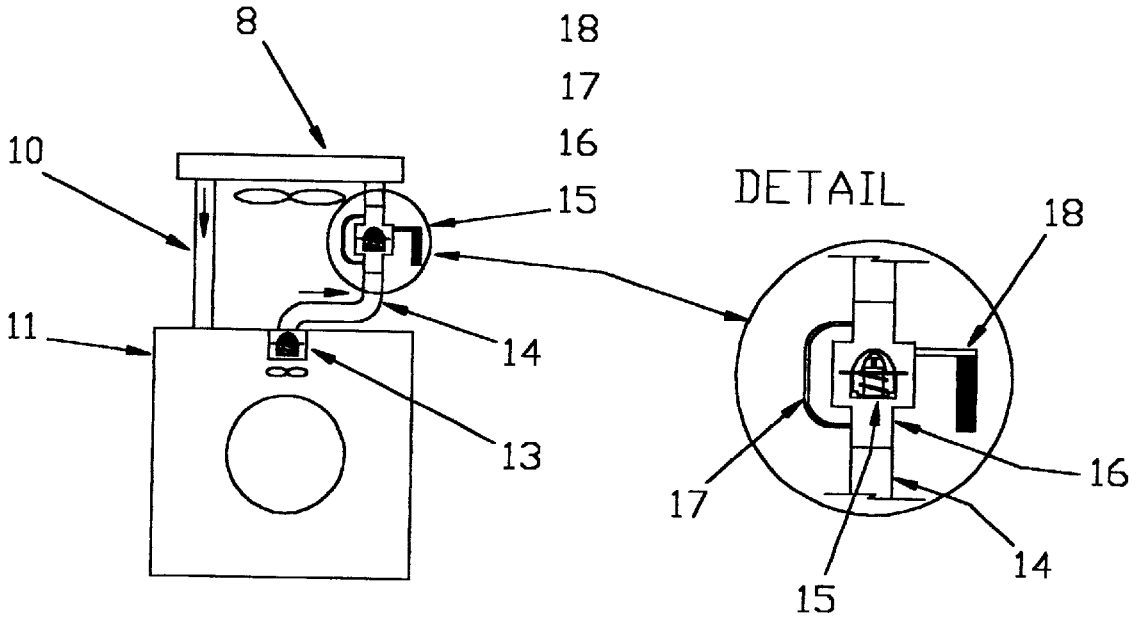
FIG. 3 illustrates the cooling system schematic of FIG. 3 with an enabling apparatus for the invention.

FIG. 3 illustrates a schematic representation of enabling apparatus for the present invention. In comparison to FIG. 3, an additional thermostat 15 is mounted in a suitably adapted housing 16 in the heated water flow passageway 14, such that heated water must flow past the initial thermostat 13 and the additional thermostat 15 in order to reach the radiator 8, eventually returning into the cooled water passageway 10 and the engine 11. In this case, thermostat 13 is selected to have a "low" temperature set-point of, for example 160 deg. F. while the additional thermostat 15 is selected to have a "high" temperature set-point of, for example 195 deg. F. There is also provided a low-flow heated water by-pass passageway 17 at the additional thermostat 15, which passageway always remains open.

Thermostat 15 is provided with an external operator or handle 18 such that operation of the handle 18 places the thermostat into a first "closed" position or a second "opened" position, as evidenced by the position of the external handle. In the first closed position, heated water must pass through the thermostat, meaning the water temperature must reach at least the "high" set point before any substantial water flow can be achieved in the heated water flow passageway 14 to the external radiator. In the second open position of the handle, however, water flow in the heated water passageway 14 can bypass the additional thermostat 15. Water flow through the cooling system in this case will be established as soon as the water temperature meets or exceeds the "low" temperature set-point of the initial thermostat 13.

It is clear, therefore, that operation of the cooling system with handle 18 in the first closed position will result in a nominal cooling water temperature of 195 deg. F. being maintained due to the operation of the additional thermostat 15, whereas operation of the cooling system with the handle 18 in the second open position will result in a nominal cooling water temperature of 160 deg. F. being maintained by the operation of the initial thermostat 13 and by-passing of the additional thermostat 15. It is also dear that the initial thermostat 13 opens fully in the first case, thereby having no controlling effect upon the cooling system water flow rate and/or temperature. The additional thermostat 15 is effectively by-passed in the second case for the open position of the handle 18, therefore it has no controlling effect upon cooling water flow rate and/or temperature in such a case.

Low-flow by-pass passageway 17 is beneficial in the first case of the selectable by-pass at additional thermostat 15 being closed, said low-flow bypass maintaining a nominal flow of heated water in flow passageway 14 after initial thermostat 13 opens, said nominal flow being adequately provided at about 10% of the unrestricted full flow rate such that heated water continually reaches the active temperature sensing element of additional thermostat 15 without significant cooling. In order to be responsive to the actual engine operating temperature, additional thermostat 15 is preferably installed in heated passageway 14 in relatively close proximity to initial thermostat 13.

It should be noted that the order of placement of the low temperature thermostat 13 and the high temperature thermostat 15 is irrelevant to the working of the said enabling apparatus, providing that the selectable by-pass means must be associated with the higher temperature thermostat, and the by-pass passageway 17 must be associated with the second series-wise thermostat. For greater clarity, thermostat 15 in FIG. 3 is in the second series-wise position with respect to thermostat 13 when considering the water flow direction in heated water passageway 14.

Figure 4:
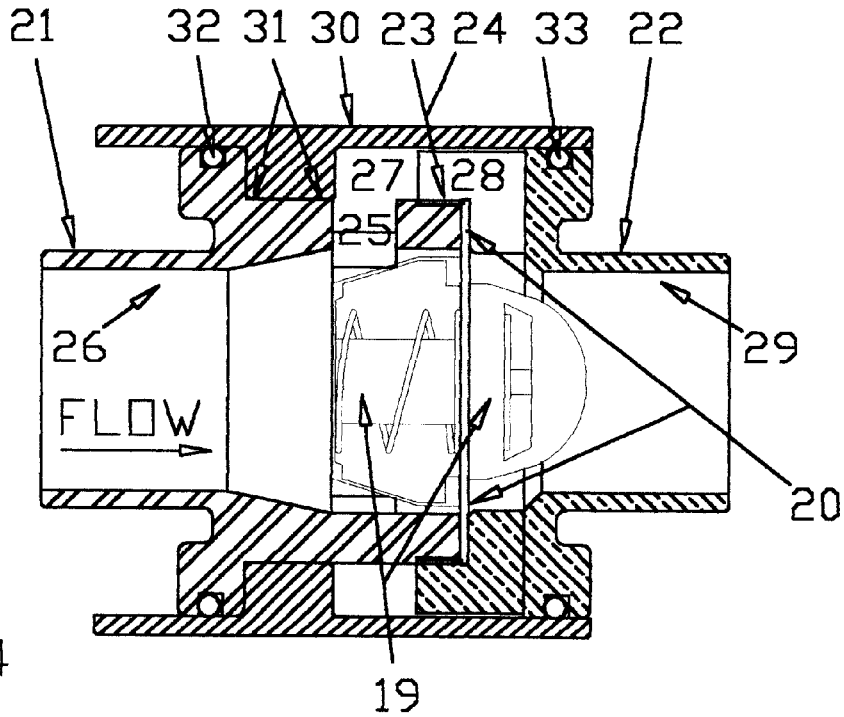
FIG. 4 is a detailed cross-sectional view of a preferred embodiment of the apparatus in a first opened position as for "summer" operation.

FIG. 4 illustrates a preferred embodiment of additional thermostat 15 of FIG. 4 in which a conventional thermostatic flow control valve element 19 is positioned and held in clamped relationship at its circular flange 20 between two cylindrical housing components 21 and 22 of a valve assembly, said housing components being assembled and retained together at male screw thread 23 on component 21 engaging with female thread 24 on housing component 22. Housing component 21 is arranged with one or more radial slots 25 providing fluid communication between internal water inlet passageway 26 and an external annular chamber 27 Housing component 22 is similarly arranged with one or more radial slots 28 providing fluid communication between external annular chamber 27 and internal water outlet passageway 29. An easily obtained design objective for the fluid passageways is that the cross-sectional flow areas be large enough as to provide little cooling water flow resistance when installed in the passageway of an internal combustion engine's water cooling system.

Figure 5:
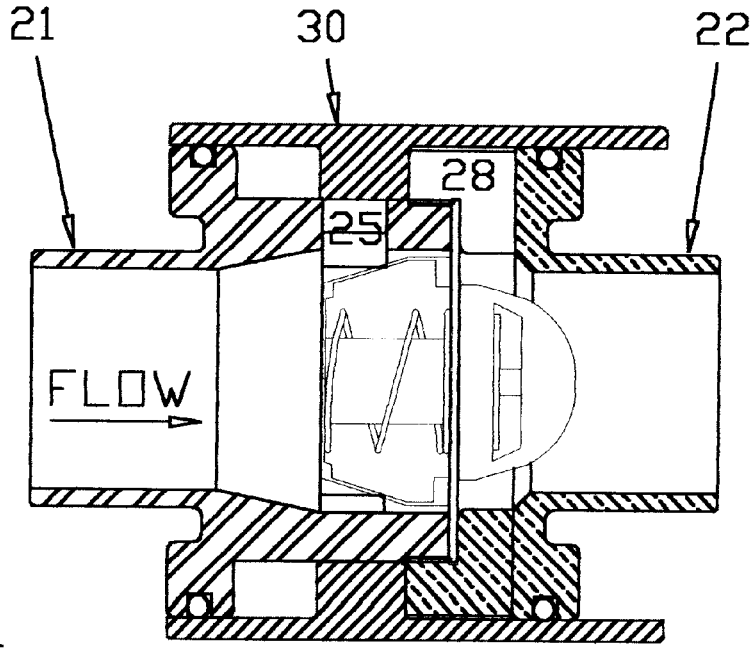
FIG. 5 is a detailed cross-sectional view of a preferred embodiment of the apparatus in a second closed position as for "winter" operation.

In the figures, external handle or operator 18 of FIG. 3 corresponds to externally operable cylindrical slide valve 30 in FIGS. 4 and 5, which is arranged with internal cylindrical land areas 31, closely enveloping cooperating cylindrical surfaces of housing component 21. Slide 30 is operable in the longitudinal direction such as between a first "open" position as in FIG. 4 allowing cooling water to by-pass the thermostatic valve element 19 freely, versus a second "closed" position as in FIG. 5 in which the fluid bypass path is effectively blocked. Detent means (not shown) are conveniently arranged between slide valve 30 and housing component 21 to retain valve 30 in either one of its open or closed positions. O-ring seals 32 and 33 in housing components 21 and 22, respectively, are arranged to form fluid seals between slide valve 30 and housing components 21 and 22, preventing fluid from leaking from the internal regions of the apparatus. Nominal internal fluid leakage paths past land areas 31 are provided via controlling the clearances at the land areas 31 between slide component 30 and housing component 21 such as to satisfy the required leakage flow path function of passageway 17 in FIG. 3.

A preferred installation of additional thermostat 15 in heated water passageway 14 in typical vehicle applications involves cutting rubber hose 14 circumferentially, thus enabling housing components 21 and 22 to be snugly inserted into the cut hose ends, which are then secured and sealed with hose clamps or the like. After installation, slide component 30 remains exposed and accessible to enable the operator of the vehicle to selectably move the slide between its open and its closed positions.

Clearly, the flow of cooling water in heated passageway 14 (and therefore its temperature) is unaffected by the presence of thermostatic valve element 19 when slide 30 is positioned to enable fluid to by-pass the thermostat. When slide 30 is positioned to close the by-pass passageway, cooling water flow is prevented until the water temperature increases to the set point temperature of thermostatic valve element 19, following which a continuous flow of cooling water circulates through the external radiator and the cooled water passageway back to the engine again, said flow being continuously regulated to maintain temperature agreement with the set point of thermostatic valve 19.

Although only two steps of temperature regulation have been described for enabling apparatus for the method of the invention, it will be obvious that any desired number of temperature steps could be achieved by employing additional series-wise thermostats mounted individually and provided with operators to achieve open and closed positions, each also incorporating a functional water flow by-pass passageway 17.

The inventor has therefore disclosed a simple method and apparatus for enabling selectable control of the cooling water temperature of an internal combustion engine. Clearly, an operator can easily move slide valve 30 to its open position, thus causing the engine's cooling water temperature to be controlled by the 160 deg. F. thermostat for improved fuel economy and/or operation under an anticipated high-load condition. Alternatively, the operator can move slide valve 30 to its closed position, thus improving the interior heater output in winter conditions in a vehicle application. If the vehicle is equipped with on-board fuel economy measuring/displaying hardware, the operator will be able to confirm that for the given loading conditions and ambient temperatures, he has selected the appropriate open or closed position of slide 30.

Whereas the embodiments already noted imply manual selection of the open and closed positions for additional thermostat 15, other embodiments will be obvious to those skilled in the art. For example, the inventor notes that any powered actuation means which could be used to operate a slide 30 of a by-pass assembly or mechanism constructed in conjunction with additional thermostat 15, would also enable selectable temperature control for the internal combustion engine.

Further, the inventor notes that any automatic means of detection of conditions leading to a decision to select the opposite of an existing open or closed position of by-passing an additional thermostat 15, and causing the selection of that opposite position by manual or automatic means, would constitute enabling apparatus for the method of the invention.

The inventor notes that although the term "water" appears throughout the disclosure of this invention, in fact, typical internal combustion engine's cooling systems are filled with a mixture of water and anti-freeze including special compounds to combat corrosion or for other purposes. The inventor respectfully requests that the reader will accept this broader definition of the term "water" when used in the sense of the cooling medium for an internal combustion engine throughout this disclosure.

What is claimed is:

1. Means for selectably regulating the cooling water temperature of a water-cooled internal combustion engine system at a first higher operating temperature or a second lower operating temperature; said internal combustion engine system consisting of at least an engine, an external radiator with interconnecting supply and return hose passageways from and to the radiator, respectively, a water circulating pump means and first and second thermostatic valves having internal thermostatic valve mechanisms operative at set point temperatures, installed in series so as to regulate the flow of cooling water in the supply hose passageway leading to the external radiator, said first thermostatic valve operating to restrict the flow of cooling water to the external radiator until the cooling water temperature increases to the thermostatic element's set point temperature, thus causing the internal valve mechanism to begin to open and to begin to regulate the water flow rate and thereby to control the water temperature at it's said set point temperature; said means comprising, in combination, said second thermostatic valve having a higher set point temperature than said first thermostatic valve and having further water by-pass passageway means installed to allow 10% of the unrestricted cooling water flow rate to by-pass the second thermostatic valve in its closed condition after the said first thermostatic valve has opened; said second thermostatic flow control valve being equipped with external operative means for selectably choosing a first operative position or a second non-operative position; said first operative position disposing water flow passageways adjacent to the valve to substantially restrict the flow of water through the external radiator until the water temperature increases to the second thermostatic valve's said higher set point temperature, thus causing the thermostatic valve mechanism to begin to open and to begin to regulate the water flow rate and thereby to control the water's temperature at said higher set point temperature; said second non-operative position disposing water flow passageways adjacent to the valve so as not to restrict or influence the cooling water flow rate; the effect of selecting said first operative position thereby achieving a first higher operating temperature for the internal combustion engine system, versus selecting the said second non-operative position thereby achieving a lower operating temperature for the internal combustion engine system, respectively.

2. Means for regulating the cooling water temperature of a water-cooled internal combustion engine system as in claim 1, wherein the water flow rate through the engine system is controlled by selecting for preferential controlling operation one of two conventional fixed set-point thermostatic flow control valves, said first thermostatic flow control valve having a set point temperature of 160 degrees Fahrenheit and said second thermostatic flow control valve having a set point temperature of 195 degrees Fahrenheit.

3. Means for regulating the cooling water temperature of a water-cooled internal combustion engine system as in claim 1 wherein selection of one or the other of a higher or a lower operating temperature condition can be made manually without disassembly of any engine or cooling system components.

4. Means for regulating the cooling water temperature of a water-cooled internal combustion engine system as in claim 1 wherein selection of one or the other of a higher or a lower engine operating temperature condition can be made remotely as by means of a push-pull cable or any other actuator means.

5. Means for regulating the cooling water temperature of a water-cooled internal combustion engine system as in claim 1 wherein selection of one or the other of a higher or a lower engine operating temperature condition can be made by a control system comprised of sensors, a computer, programmed logic and powered actuator means.

6. Means for regulating the cooling water temperature of a water-cooled internal combustion engine system as in claim 1, said means being uniquely simple to implement as a retrofit to existing conventional internal combustion engine systems by use of said enabling apparatus.

7. Means for regulating the cooling water temperature of a water-cooled internal combustion engine system as in claim 1 in which the cooling water could alternatively be any cooling medium including mixtures of antifreeze with water or any other composition of appropriate cooling media.

* * * * *